United States Patent [19]

Smith et al.

[11] Patent Number: 4,474,616

[45] Date of Patent: Oct. 2, 1984

[54] BLENDING TAR SANDS TO PROVIDE FEEDSTOCKS FOR HOT WATER PROCESS

[75] Inventors: Russell G. Smith; Laurier L. Schramm, both of Edmonton, Canada

[73] Assignees: Petro-Canada Exploration Inc., Calgary; Her Majesty the Queen in right of the Province of Alberta as represented by the Minister of Energy and Natural Resources, Edmonton; PanCanadian Petroleum Limited, Calgary; Esso Resources Canada Limited, Calgary; Canada-Cities Service, Ltd., Calgary; Gulf Canada Limited, Toronto; Alberta Energy Company Ltd., Calgary; Hudson's Bay Oil and Gas Company Limited, Calgary; Petrofina Canada Inc., Calgary, all of Canada; a part interest

[21] Appl. No.: 561,118

[22] Filed: Dec. 13, 1983

[51] Int. Cl.[3] ..... C10G 1/04

[52] U.S. Cl. ..... 208/11 LE

[58] Field of Search ..... 585/8 R, 8 LE, 11 R, 585/11 LE

[56] References Cited

U.S. PATENT DOCUMENTS 4,201,656 5/1980 Sanford ..... 208/11 LE

FOREIGN PATENT DOCUMENTS 639050 3/1962 Canada ..... 208/11 LE
1012083 6/1977 Canada ..... 208/11 LE
1094483 1/1981 Canada ..... 208/11 LE

*Primary Examiner*—Delbert E. Gantz
*Assistant Examiner*—A. Pal
*Attorney, Agent, or Firm*—Millen & White

[57] ABSTRACT

Two or more tar sand feeds are blended in specified proportions in combination with a specified dosage of NaOH to provide a slurry, having a free surfactant content dissolved in the aqueous phase of the slurry, which yields the maximum possible primary froth production from the hot water extraction process.

3 Claims, 6 Drawing Figures

LABORATORY BATCH EXTRACTION UNIT

ACID TITRANT VERSUS pH
TO DETERMINE SURFACTANT
CONCENTRATION

BLENDING TAR SANDS TO PROVIDE FEEDSTOCKS FOR HOT WATER PROCESS

FIELD OF THE INVENTION

This invention relates to an improvement of the hot water process for extracting bitumen from tar sand. More particularly, it relates to process control, specifically control of process aid addition, whereby primary bitumen froth recovery may be maximized, in spite of the changing nature of the tar sand feed.

BACKGROUND OF THE INVENTION

Tar sand, also known as oil sand and bituminous sand, is now well recognized as a valuable source of hydrocarbons. There are presently two large plants producing synthetic crude from the tar sands of the Athabasca region of Alberta. In these operations, the tar sands are first mined and the bitumen is then extracted from the tar sand by a process called the hot water process. The extracted bitumen is subsequently upgraded by refinery-type processing to produce the synthetic crude.

The tar sand is a mixture of sand grains, connate water, fine minerals solids of the particle size of clay minerals, and bitumen. It is commonly believed that the connate water envelops the grains of sand, the fine solids are distributed in the water sheaths, and the bitumen is trapped in the interstitial spaces between the water-sheathed grains.

The hot water process is now well described in the patent and technical literature.

In broad summary, this process comprises first conditioning the tar sand, to make it amenable to flotation separation of the bitumen from the solids. Conditioning involves feeding mined tar sand, hot water (180° F.), an alkaline process aid (usually NaOH), and steam into a rotating horizontal drum wherein the ingredients are agitated together. Typically, the amounts of reagents added are in the following proportions:

tar sand—3250 tons
hot water—610 tons
NaOH—4 tons (20% NaOH)

Enough steam is added to ensure an exit temperature of the mixture from the drum of about 180° F. The residence time in the drum is typically about 4 minutes.

During conditioning, the mined tar sand (in which the bitumen, connate water and solids are tightly bound together) becomes an aqueous slurry of porridge-like consistency, wherein the components are in loose association.

The slurry leaving the drum is screened, to remove oversize material, and then flooded or diluted with additional hot water. The product typically comprises 7% by weight bitumen, 43% water and 50% solids. Its temperature is typically 160°-180° F.

The diluted slurry then is transferred to the primary separation operation, where it is introduced into a large separation vessel having a cylindrical upper section and conical lower section. Here the slurry is retained for about 45 minutes in a quiescent condition. Most of the sand sinks to the bottom and is discharged, together with some fines, water, and bitumen, through an outlet. This discharge is discarded as tailings.

The bitumen present in the separation vessel exists in the form of globules, some of which attach themselves to air bubbles entrained in the slurry during conditioning. The aerated bitumen tends to rise through the slurry and is recovered as a froth by a launder extending around the upper lip of the separation vessel. This froth is called primary froth. Typically, it comprises:

| | |
|---|---|
| 66.4% | bitumen |
| 8.9% | solids |
| 24.7% | water. |

Not all of the bitumen becomes sufficiently aerated to rise into the primary froth product. Much of this bitumen, together with much of the fines, tends to collect in the mid-section of the separation vessel. This aqueous mixture is termed "middlings".

The middlings are withdrawn from the vessel and are fed into subaerated flotation cells where secondary separation is practiced. Here the middlings are subjected to vigorous agitation and aeration. Bitumen froth, termed "secondary froth", is produced. Typically, this froth comprises:

| | |
|---|---|
| 23.8% | bitumen |
| 17.5% | solids |
| 58.7% | water. |

It will be noted that the secondary froth is considerably more contaminated with water and solids than the primary froth. One seeks to minimize this contamination, as the froth stream requires downstream treatment to remove solids and water, before it can be fed to the upgrading process.

It is desirable to operate the process so that as much of the bitumen as possible reports to the primary froth. The efficiency with which bitumen is collected as primary froth is a measure of the success with which the entire bitumen in the tar sand feed has been brought to a condition amenable for spontaneous flotation. For this reason, one may consider maximizing primary recovery as optimizing the entire process.

Now, the tar sand feed to the hot water process is not uniform in nature. Its properties vary in accordance with factors such as bitumen content, fines content, nature of the coarse solids, extent of ageing and weathering after mining, and the chemical nature of the bitumen. This variation in properties of the feedstock requires that the processing conditions be altered from time to time with a view to maximizing primary froth recovery. Some optimizing techniques, such as regulating middlings density within a preferred range or maintaining the temperature within a preferred narrow range, can assist in improving recovery over a narrow variation in the nature of the tar sand feed. But there is a need for identification of a parameter which can be monitored and used to maximize primary froth recovery over a wide range of different tar sand types.

At this point, it is useful to review the role of the "process aid", as it was understood in the past. The originator of the hot water process, Dr. Karl Clark, noted that the tar sand was acidic in nature. He taught the need to add an alkaline process aid, such as NaOH, to adjust the pH of the drum slurry to near neutral condition, in order to improve bitumen recovery in the primary separation step. Later investigators taught that it was desirable to maintain a slurry pH in the range of about 8-9, to maximize bitumen recovery.

More recently, Dr. Emerson Sanford, co-worker of the present applicants, set forth in Canadian Pat. Nos. 1,100,074 and 1,094,003 that the role of the NaOH was to produce surfactants in the slurry by reaction with carboxylic and sulfonic acid substituents present in the bitumen. He submitted that it was surfactants that were needed to condition the tar sand to free the bitumen from the other tar sand components and render said bitumen amenable to air attachment. He further taught that the level of fines would affect the surfactant requirements. It was believed the fines would absorb surfactants, thereby diminishing their availability for 'conditioning'. In summary, he taught that:

(1) some process aid was needed for good primary recovery;
(2) the process aid functioned by generating surfactants within the slurry, which surfactants were required to maximize bitumen recovery; and
(3) different tar sand types, having different fines contents, would require different quantities of NaOH in order to achieve maximum primary froth production.

As mining and geological inspection of the Athabasca deposit has expanded, it has become evident that there are oil sand types that do not follow the relationships between recovery and process aid addition that one would have anticipated.

One such deviation arises from the nature of the clays. It now appears that clays differ in their capacity to adsorb surfactants. Those that are so placed in the deposit as to be in contact with bitumen can have surfaces thoroughly impregnated with hydrocarbon molecules and may not have sites available for surfactant adsorption. Clays laid down in later eras, and forming part of the overburden, may have hydrocarbon-free surfaces, in which case they are strong surfactant adsorbers. If, during mining, some of the overburden gets included in the feed sent to extraction, these non-impregnated clays "poison" the slurry by adsorbing surfactants. When the extraction circuit has been optimized for non-adsobring clays, the introduction of feed containing overburden clays will lead to reduced recovery. Some oil sands are so rich in surfactant-adsorbing clays that the power of the contained bitumen to contribute surfactants to the slurry is more than offset by the tendency of the clays to adsorb surfactants.

A second deviation from "normal" behaviour is the deterioration of oil sand after mining. During storage, feed can age. The mechanism is not understood, but the bitumen surface properties appear to alter, with the result that separation from the solids and attachment of air are made more difficult.

A third deviation arises in the case of feeds rich in bitumen. Some have been found to produce such a high level of surfactants, without any process aid addition, that the slurry is always in an over-conditioned state. Over-conditioning results in bitumen losses from the separation vessel, presumably due to emulsification.

Trying to control the process by monitoring some property of the feed is thus liable to failure because the relationships between such property and recovery can be subject to abberrations.

A safer procedure is to use some property of the slurry, once prepared, rather than of the feed, to determine the needed dosage of process aid.

There is thus a need to identify a reliable parameter which can be used to optimize NaOH addition and to determine a strategy for best combining the various types of tar sand to offset their undesirable qualities with respect to surfactant production and consumption.

SUMMARY OF THE INVENTION

The present invention is based in part on the discovery that, for a particular circuit, there is a critical or optimum concentration of free surfactant in solution in the aqueous phase of the process slurry (hereinafter "$C_o$"), which always is required to obtain maximum recovery of bitumen from tar sand in the form of primary froth.

The discovery was arrived at by running a number of batch hot water process extractions on a single tar sand feed, while varying only the amount of process aid used. When primary froth recovery was plotted against concentration of free surfactant in the aqueous phase of the process slurry (hereinafter "$C_s$"), a peak curve was obtained. When this procedure was repeated for a number of different tar sands, a peak curve was obtained in each case and the peaks were found to occur at substantially the same $C_s$ value. This common peak $C_s$ value is the optimum concentration $C_o$.

So, for a particular circuit, a single free surfactant value $C_o$ leads to maximum primary froth recovery, regardless of the nature of the tar sand feedstock being processed.

Having made this discovery, a general process has been evolved comprising the following steps:

(1) determining, for the extraction apparatus or circuit used, a measure of $C_o$ for one tar sand feed;
(2) then establishing $C_s$ from time to time as different tar sand feeds are processed; and
(3) varying the process aid addition to the process as the nature of the tar sand feed changes, to thereby maintain $C_s$ as close to $C_o$ as possible.

The foregoing general process has been described and claimed in our co-pending United States patent application Ser. No. 476,025, which is incorporated herewith by reference.

The general process has now advantageously been applied in connection with feedstocks, for the hot water process, which consist of blends of two or more different tar sand feeds. If a plurality of different tar sand feeds, which satisfy criteria set forth below, are selected and combined in certain proportions, which are set forth in a range defined below, and if this blend is combined with process aid in an amount within a range defined below, then, when this mixture is used in the hot water process, two results occur:

(1) $C_s$ is found to equate substantially with $C_o$; and
(2) the primary froth recovery obtained is greater than that which would be obtained if one processed each of the tar sand feeds separately.

The use of blended feedstock and process aid as aforesaid in the hot water process is characterized by an important advantage. The invention enables certain tar sand feeds, which could not by themselves be processed at $C_o$ condition, to be so processed.

More particularly, there are certain tar sand feeds which, when slurried, initially are consumers of free surfactants. These tar sand feeds usually have a high fines content. The fines tend to adsorb the free surfactants; this is particularly the case when the fines are not well impregnated with bitumen. Thus, when a tar sand of this type is processed, a relatively large quantity of process aid would be required to bring $C_s$ to the $C_o$ value. Now, there is a known limit on the amount of process aid which can be used in the hot water process. This is generally taken to be about 0.2 wt. %, based on the dry tar sand. If this limiting amount of process aid is exceeded, the hot water process is deleteriously affected by such effects as emulsification of bitumen and poor froth/middlings interface. By blending these free surfactant-consuming tar sand feeds with others, as described below, they can now be processed at $C_o$ condition without exceeding the 0.2 wt. % limit.

There are other tar sand feeds, usually high in bitumen content, which, when slurried, produce such a high concentration of free surfactants that they cannot be procesed in conventional fashion at $C_o$ condition. These tar sand feeds, when slurried, yield a $C_s$ value which is so high that it is on the downslope of the peak curve. By blending these free surfactant-producing tar sand feeds with free surfactant-consuming feeds, both types of feeds can now be processed at $C_o$ condition.

Broadly stated, the invention is a process for extracting bitumen from tar sand of varying nature using the hot water process in an extraction circuit, wherein the tar sand is conditioned, by slurrying it with hot water and alkaline process aid with agitation, is diluted with water, and is then retained in a quiescent condition to produce primary bitumen froth. The improvement comprises: selecting a first tar sand feed which, when slurried, is a consumer of free surfactants and a second tar sand feed which, when slurried, is a producer of free surfactants; and blending said first and second tar sand feeds with process aid in the conditioning step in amounts selected to yield substantially the optimum free surfactant condition, in the aqueous phase of the process slurry for the circuit, required to yield maximum primary froth recovery.

DESCRIPTION OF PREFERRED EMBODIMENT

The invention is a process which has evolved from laboratory experimentation, using bench scale equipment and involving the measurement of certain parameters and the treatment of the measurement data acquired. It is necessary to go into this experimental background, in order to comprehend the invention.

The Laboratory Extraction Unit

The laboratory batch extraction unit shown in FIG. 1 was used to develop the data set forth below. A detailed description of this unit and its operation is given in the paper by E. C. Sanford and F. A. Seyer entitled "Processability of Athabasca Tar Sand Using a Batch Extraction Unit: The Role of NaOH" in the Canadian Institute of Mines Bulletin, 72, (1979), at page 164. This paper is incorporated herein by reference.

Experience has shown that the practise of the hot water extraction process on tar sand in this unit gives results which closely parallel those of the commercial hot water extraction process plant operated by the assignees of this application.

Figure 1:
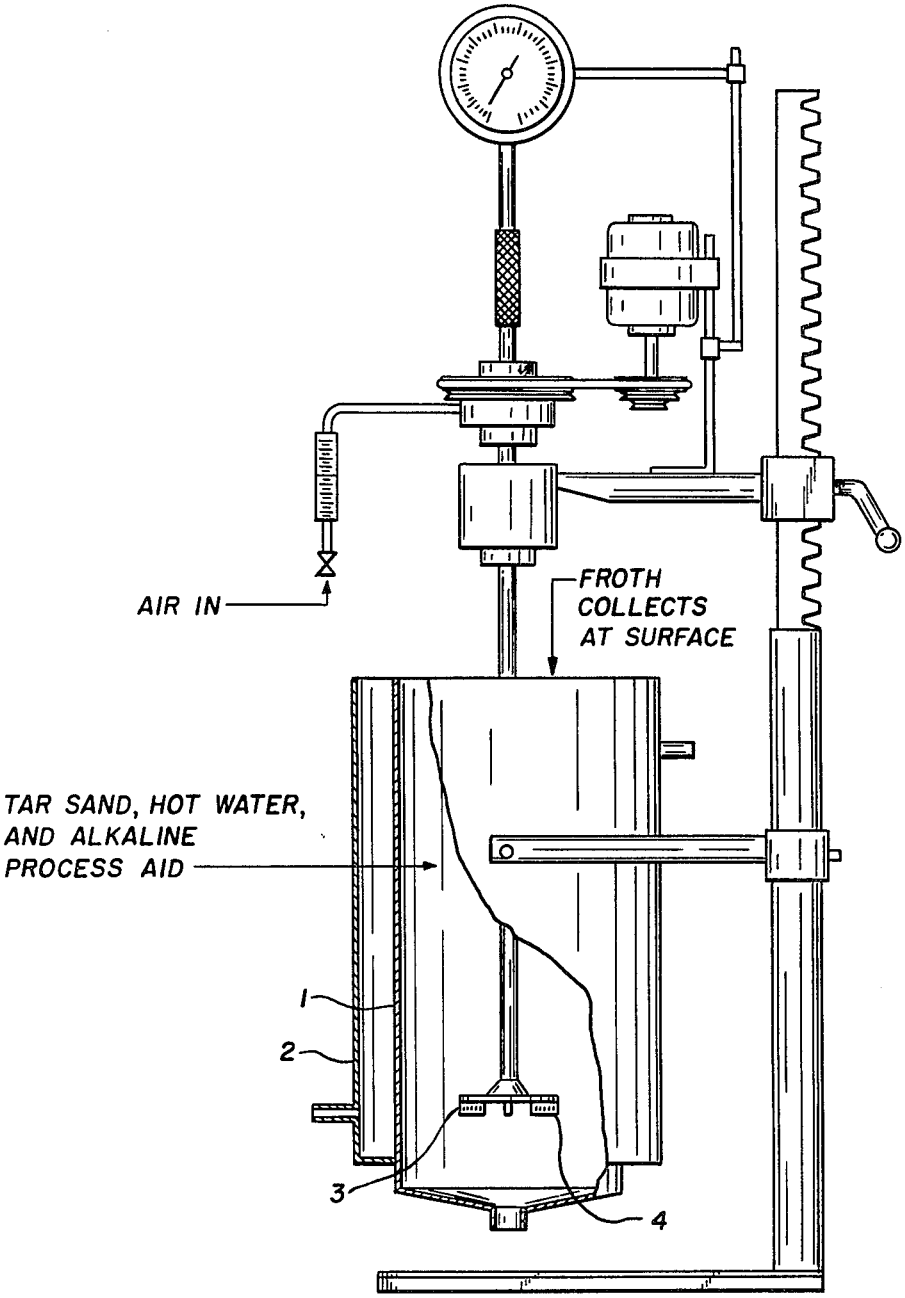
FIG. 1 is a side view of a laboratory hot water process batch extraction unit used to develop the data underlying this invention.

The extraction unit of FIG. 1 comprises a steel pot 1 having a hot water heating jacket 2 for temperature control. An agitator 3 for stirring and a sparger 4, for the introduction of air, extend into the pot.

In the operation of the extraction unit, a charge of tar sand, water and NaOH is introduced into the pot. The pot contents are then heated by the jacket. Once at the desired temperature, the charge is agitated and air is sparged into the slurry, to simulate the step of conditioning in a drum. The air sparging is then stopped and additional hot water is added, to simulate the step of flooding or dilution. Agitation is continued for a few minutes, to mix the components. The product is then retained in the pot under quiescent conditions, to simulate primary separation or floatation. Primary bitumen froth is produced during this step. This froth is skimmed off. The residual mixture is then again agitated with vigorous air sparging, to simulate secondary separation. Secondary froth is produced and skimmed off. The material left in the pot is referred to hereafter as 'secondary tailings'.

The determination of $C_s$ values was arrived at using the aqueous phase of this secondary tailings as the feedstock for analysis. The bitumen recoveries were based on the bitumen contents and amounts of the froth produced and skimmed off.

Free Surfactant ($C_s$) Determination

The invention has necessitated the utilization of a method for measuring $C_s$, the concentration of free surfactants dissolved in the aqueous phase of the process slurry.

Before describing the method used, it is useful to explain that, for purposes of this specification, "free surfactants" is a term used to denote the surface active compounds which are in aqueous solution during hot water processing of a tar sand feed. It is believed that, in the main, these compounds are the carboxylate salts which are the reaction products of NaOH (the process aid) and carboxylic groups associated with the bitumen.

It needs to be noted that not all of the carboxylates in the aforesaid aqueous phase are surface active. Therefore, it is a necessary part of the free surfactant determination method to differentiate between the carboxylates or compounds which are surface active and those that are not. This is further dealt with below.

The free surfactant determination procedure which has been utilized takes advantage of the fact that surfactants collect at surfaces. More particularly, a technique known as foam fractionation was used to collect the surface active compounds present in a slurry aqueous phase sample of known volume. This foam fractionation procedure is described in the paper by C. Bowman entitled "Molecular and Interfacial Properties of Athabasca Tar Sands", published in Proceedings 7th World Petroleum Congress, 3, (1967), pages 583–604. This paper is incorporated herewith by reference.

In greater detail, each sample of secondary tailings from the batch extraction unit was centrifuged at 15,000 G, to remove suspended solids. A 200 $cm^3$ sample of the remaining aqueous phase was foam fractionated in a 300 $cm^3$ cylindrical vessel equipped with a nitrogen sparger. The introduction of gas was varied as required to yield a separable foam. Fractionation was continued until the surface tension of the residue reached a limiting value, substantially that of pure water, as determined by the known maximum bubble pressure technique.

At this point, all of the surface active compounds were isolated in the fractionate and the residue contained only non-surface active compounds. The concentration of non-surface active compounds was assumed to be equal in each of the fractionate and residue fractions.

50 $cm^3$ aliquots of each of the fractionate and residue fractions were then titrated against hydrochloric acid, to establish measures of the concentrations of the surface active and non-surface active compounds.

Figure 6:
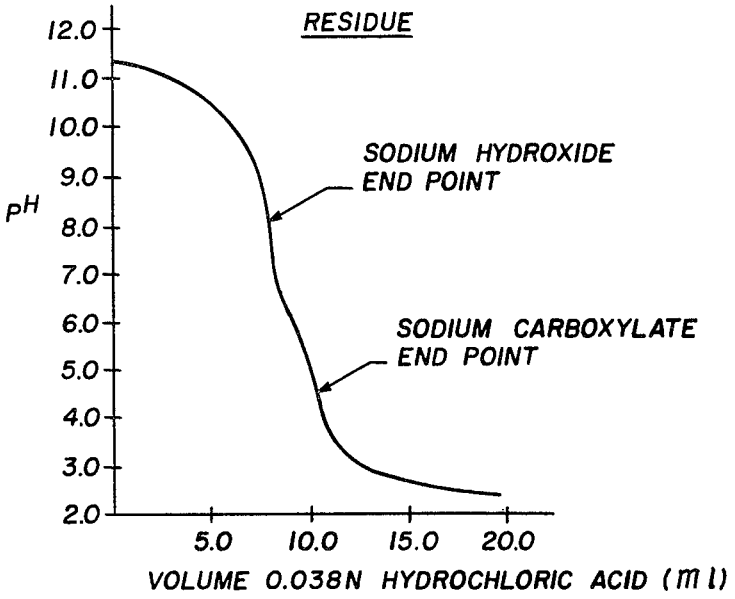
FIG. 6 sets forth titration curves used in the determination of free surfactant concentration.
Figure 7:
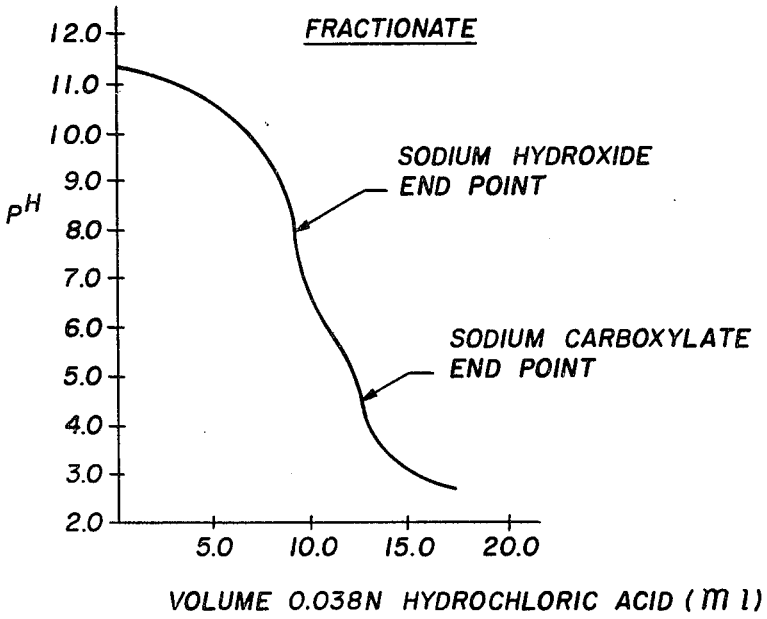

Typical titration curves are illustrated in FIG. 6. It will be noted that the volumes of acid, used to titrate the non-surface active carboxylates in the residue and the non-surface active plus surface active carboxylates in the fractionate, can be determined from FIG. 6 using the end points shown.

The data from these titrations were processed using the following mathematical analysis to determine free surfactant concentration ($C_s$), as follows:

let $C_{ns}^f$ be the concentration of non-surface active carboxylates in the fractionate;

let $C_s^f$ be the concentration of surface active carboxylates in the fractionate;

let $C_{ns}^r$ be the concentration of non-surface active carboxylates in the residue;

let $C^f$ be the concentration of total carboxylates in the fractionate;

and let $C^r$ be the concentration of total carboxylates in the residue.

Therefore:

$$C_{ns}^f + C_s^f = C^f \quad (1)$$

and $$C_{ns}^r = C^r \quad (2)$$

At equilibrium, the concentration of non-surface active carboxylates is assumed to be the same in both the residue and fractionate.

Therefore:

$$C_{ns}^f = C_{ns}^r$$

Thus, combining equations (1) and (2):

$$C^r + C_s^f = C^f \quad (3)$$

As $C^f$ and $C^r$ are determined by titration, the value of $C_s^f$ (the measure of free surfactant concentration) may be determined.

Detailed results of a free surfactant determination for one marine ore feed D are now presented, in conjunction with Table I:

TABLE I

| NaOH wt % on Feed | Tlgs vol $cm^3$ | Volume frac'd $cm^3$ | Vol of frac'te $cm^3$ | Frac'te aliquot $cm^3$ | Vol HCl $cm^3$ | $N_{HCl}$ | Vol resid $cm^3$ | Resid aliquot $cm^3$ | Vol HCl $cm^3$ |
|---|---|---|---|---|---|---|---|---|---|
| .00 | 1080 | | | | | | | | |
| .04 | 1080 | 199.5 | 103.7 | 50.0 | .49 | .0571 | 91.3 | 50.0 | .46 |
| .08 | 1080 | 208.1 | 91.9 | 50.0 | .48 | .0571 | 115.4 | 50.0 | .43 |
| .12 | 1080 | 197.8 | 115.2 | 50.0 | .89 | .0571 | 79.7 | 50.0 | .84 |
| .20 | 1080 | 152.2 | 62.1 | 61.9 | 3.34 | .0328 | 89.7 | 50.0 | 2.40 |

Total secondary tailings sample volume = 1080 $cm^3$
Fractionate carboxylate salt determination:
Total volume fractionated = 152 $cm^3$ = $V_{sample}$
Volume of fractionate = 62 $cm^3$ = $V_{frictionate}$
Aliquot volume = 61.7 $cm^3$ = $V_{aliquot}$
Volume of HCl titrant = 3.34 $cm^3$ = $V_{HCl}$
Normality of HCl = 0.0328N = $N_{HCl}$
Therefore
Concentration of carboxylate salts in fractionate =

$$\frac{N_{HCl} \cdot V_{HCl}}{V_{aliquot}} = 17.8 \times 10^{-4}$$

Residue carboxylate salt determination:
Residue volume = 90 $cm^3$
Aliquot volume = 50.0 $cm^3$ = $V_{aliquot}$
Volume of HCl titrant = 2.40 $cm^3$ = $V_{HCl}$
Normality of HCl = 0.0328N = $N_{HCl}$
Therefore
Concentration of carboxylate salts in residue =

$$\frac{N_{HCl} \cdot V_{HCl}}{V_{aliquot}} = 15.7 \times 10^{-4}$$

TABLE I-continued

From the equations $C_s = C^f - C^r$ $= 17.8 \times 10^{-4} - 15.7 \times 10^{-4}$ $= 2.1 \times 10^{-4}$ equivalents per liter This is the concentration of free surfactant in the 62.1 $cm^3$ fractionate sample. In the original tailings sample there is $$\frac{(2.1 \times 10^{-4}) \times 62.1}{152} = 8.6 \times 10^{-5} \text{ equivalents per liter.}$$

Optimum Free Surfactant ($C_o$) Determination

As previously stated, a number of hot water process extraction runs were carried out on a particular feed in the batch extraction unit, varying only the amount of NaOH addition. When the $C_s$ values obtained from the runs were plotted, a peak curve, such as one of the curves shown in FIG. 1, was obtained. This procedure was repeated for a number of different feeds. It was discovered that the peaks of the curves, corresponding with the maximum primary froth recoveries, fell substantially on a vertical line corresponding with a single $C_s$ value. This particular optimum $C_s$ value is referred to as $C_o$.

Stated otherwise, maximum primary froth recovery for the various feeds occurs at only one small range of $C_s$ values. Both below and above that range, which for practical purposes is taken to be a single value $C_o$, the primary froth recovery diminishes.

To summarize, for a given circuit or extraction unit, the maximum primary froth recovery for various tar sand feeds always occurs at substantially the same free surfactant concentration $C_o$ in the aqueous phase of the process slurry.

Figure 3:
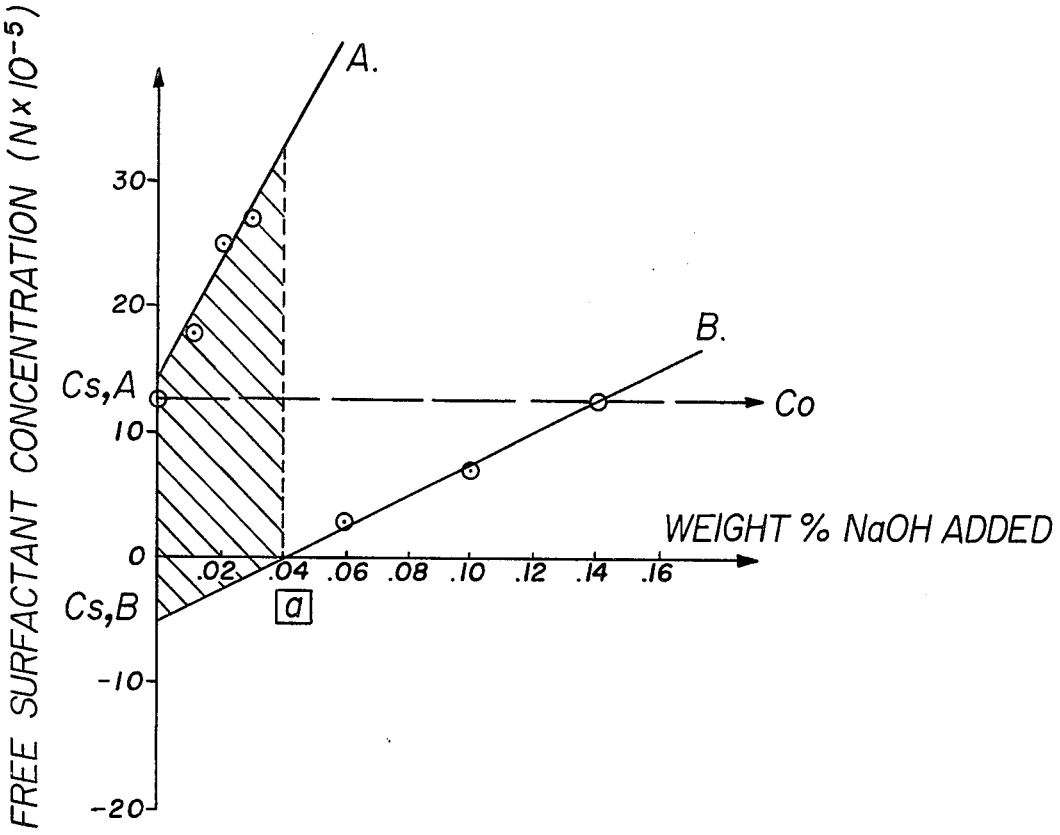
FIG. 3 is a plot of free surfactant concentration obtained in the aqueous phase of the process slurry ($C_s$) against dosage of NaOH process aid used in the process—line A is the surfactant production line obtained by treating samples of surfactant-producing tar sand A with different amounts of NaOH, and line B is the surfactant production line obtained by treating samples of a surfactant-consuming tar sand B—the dotted horizontal line corresponds with $C_o$ (the optimum concentration of free surfactant in the aqueous phase of the process slurry for the extraction unit involved, which concentration corresponds with that associated with maximum primary bitumen froth recovery)

The Linear Relationship (FIG. 3)

In conjunction with determining $C_o$ for the extraction unit used, one may determine, for each tar sand feed being considered, the nature of the substantially linear relationship which exists between $C_s$ and NaOH addition.

This may be done by: extracting a plurality of portions of each tar sand feed; using the hot water process at constant conditions except for using different levels of NaOH addition; determining the $C_s$ value for each such extraction; and establishing the nature of the linear relationship by plotting the linear surfactant production line for each feed, which line expresses this relationship.

A typical plot of surfactant production lines, based on experimental runs described below, is set forth in FIG. 3. It will be noted that each surfactant production line is extrapolated to intersect the zero NaOH addition axis and provide an intercept value. Also, a horizontal broken line is provided on the plot, which corresponds with the $C_o$ value for the extraction unit used.

Line A on FIG. 3 is the surfactant production line obtained in connection with extraction of a tar sand feed A, which is relatively high in bitumen content. This feed had the following composition:

TABLE II

| Tar Sand | Comments | Oil Content % w/w | Water Content % w/w | Solids Content % w/w | Fines Content (< −44) % w/w solids |
|---|---|---|---|---|---|
| A (rich) | fresh | 13.7 | 1.5 | 84.8 | 8.9 |

The extraction procedure used on each tar sand sample, to develop the data for lines A (and line B described below), was as follows:

A charge of 500 g of the tar sand, 150 mL of water at 82° C., and different amounts of NaOH were introduced into the pot 1. Hot water was circulated through the jacket 2 to bring the charge to 82° C. and to maintain it there. Once the charge was at temperature, it was agitated with the agitator 3 for 10 minutes at 600 rpm while simultaneously introducing air into the charge at 7 mL per second through the sparger 4. The air was then switched off and the mixture flooded with 900 mL of hot water (82° C.) Mixing with the agitator was continued for a further 10 minutes. The agitator was then switched off. The produced primary froth was skimmed off the surface of the mixture and weighed. Samples thereof were analyzed. The residual mixture was then subjected to secondary separation. More particularly, it was agitated at 800 rpm for 5 minutes with air sparging at the rate of 4 mL/sec. The secondary froth produced was skimmed off, weighed and analyzed.

The extraction results for tar sand feed A were as follows:

TABLE III

| NaOH % w/w tar sand | Mass Primary Froth (g) | Froth Composition (% w/w) Oil | $H_2O$ | Solids | % Primary Recovery |
|---|---|---|---|---|---|
| 0.00 | 53.5 | 71.1 | 19.5 | 9.4 | 85.4 |
| 0.01 | 28.9 | 71.2 | 22.4 | 6.4 | 53.0 |
| 0.02 | 32.0 | 74.8 | 18.7 | 6.5 | 55.0 |
| 0.03 | 32.0 | 75.6 | 17.3 | 7.1 | 57.4 |

It will be noted from the composition set forth in Table II that line A is the surfactant production line for a tar sand feed high in bitumen content. As shown in FIG. 3, the line obtained has a relatively steep slope, indicating that high concentrations of free surfactant are produced when extractions are carried out.

It will further be noted from FIG. 3, at zero NaOH addition, the bitumen-rich tar sand feed A produces such a high concentration of free surfactants that the $C_s$ value is greater than the $C_o$ value. The data of Table III indicates that the primary froth recoveries from processing this rich tar sand alone fall on the right hand downwardly sloping portion of the feed A curve on FIG. 1. Thus, oil recovery by hot water extraction from this tar sand alone is less than the maximum possible, when this feed is processed in the ordinary way with NaOH addition.

Line B on FIG. 3 is the surfactant production line obtained from extracting a tar sand feed B, known as marine ore, which was low in bitumen content and rich in clay particles. As shown, the slope of this line was less angular than that of line A, indicating that a lower concentration of free surfactants was generated.

Tar sand feed B had the following composition:

TABLE IV

| Tar Sand | Comments | Oil Content % w/w | Water Content % w/w | Solids Content % w/w | Fines Content (° −44) % w/w solids |
|---|---|---|---|---|---|
| B (marine) | aged 60 days | 5.6 | 10.3 | 85.0 | 21.0 |

The extraction results for tar sand feed B were as follows:

TABLE V

| NaOH % w/w tar sand | Mass Primary Froth (g) | Froth Composition (% w/w) Oil | $H_2O$ | Solids | % Primary Recovery |
|---|---|---|---|---|---|
| 0.01 | 1.01 | 26.35 | 64.64 | 9.01 | 3.6 |
| 0.03 | 1.20 | 36.45 | 54.88 | 8.67 | 4.3 |
| 0.06 | 1.40 | 42.72 | 49.97 | 7.31 | 4.1 |
| 0.12 | 1.32 | 38.66 | 52.94 | 8.40 | 4.7 |
| 0.16 | 1.99 | 47.58 | 44.98 | 7.44 | 7.1 |
| 0.20 | 1.51 | 40.27 | 51.52 | 8.22 | 5.4 |
| 0.24 | 0.84 | 39.83 | 52.16 | 8.01 | 3.0 |

As can be seen, the primary recovery of bitumen from this feed B was very low when it was processed alone.

Of particular interest is that portion of line B to the left of point 'a' on the plot. Here, for extractions conducted on feed B at NaOH additions in the range 0.0 to 0.4 wt %, there is a condition of free surfactant consumption. Stated otherwise, in the case of tar sand B and an NaOH addition in said range, the tar sand appears to be adsorbing the free surfactants that it produces when in the extraction slurry.

Blending

We postulated that, if a first tar sand feed, which is a consumer of free surfactants, were to be blended with a second tar sand feed, which is a producer of free surfactants, it might be possible to achieve $C_o$ conditions. By 'producer' is meant that the tar sand, when processed alone by the hot water process in accordance with conventional conditions, will yield a surfactant production line which, in the context of FIG. 3 plot, is always positive (as is the case with line A). By 'consumer' is meant that the tar sand yields a surfactant production line which is partly negative (as is the case with line B).

In fact, it has been discovered that there is a synergistic result obtainable, in that certain blends give higher recoveries than would be expected by summing the results of processing each tar sand feed separately.

Figure 5:
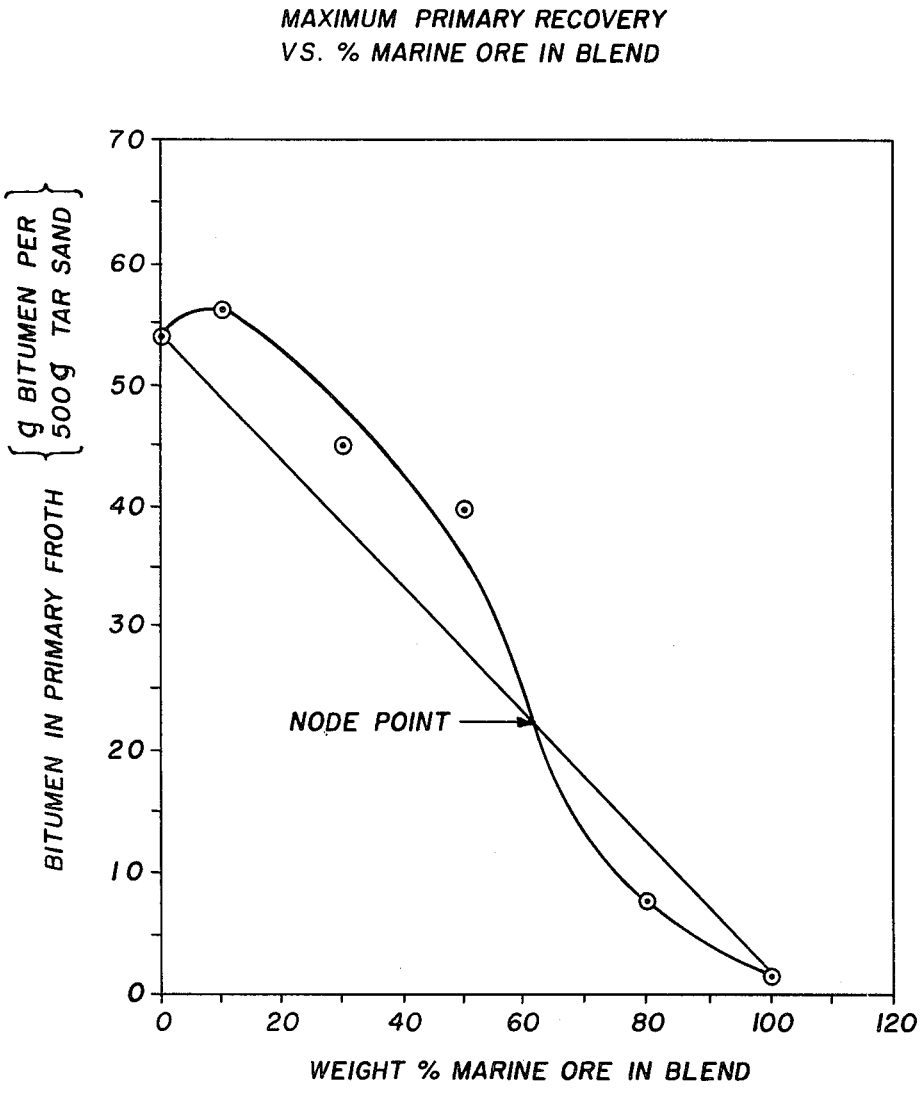
FIG. 5 is a plot of maximum primary froth recovery against composition of blend (expressed in terms of % marine ore in the blend)—this plot shows the synergism which arises with respect to primary recovery with certain blends are used.

This synergistic effect is shown in FIG. 5. Feeds A and B were blended in various proportions and subjected to bitumen extraction in the previously described extraction unit. The extraction results were as follows:

TABLE VI

| Blend Composition (% Marine) | Maximum Primary Recovery (g bitumen/500 g feed) | Maximum Primary Recovery (%) |
|---|---|---|
| 0 | 54 | 85 |
| 10 | 56 | 93 |
| 30 | 45 | 87 |
| 50 | 37 | 85 |
| 80 | 8 | 22 |
| 100 | 1 | 5 |

The straight line in FIG. 5 is the calculated recovery that was expected from blending alone, taking into account the proportion of each feed in the blend. The curve depicts the actual recoveries obtained when blends of tar sands A and B where extracted as described above. The upper part of the curve, between the left axis of the plot and the node point, shows enhanced recoveries due to synergism.

The node point on FIG. 5 corresponds with point 'a' on FIG. 3.

The shaded area on FIG. 3 defines the blend proportions which will yield synergism.

Figure 4:
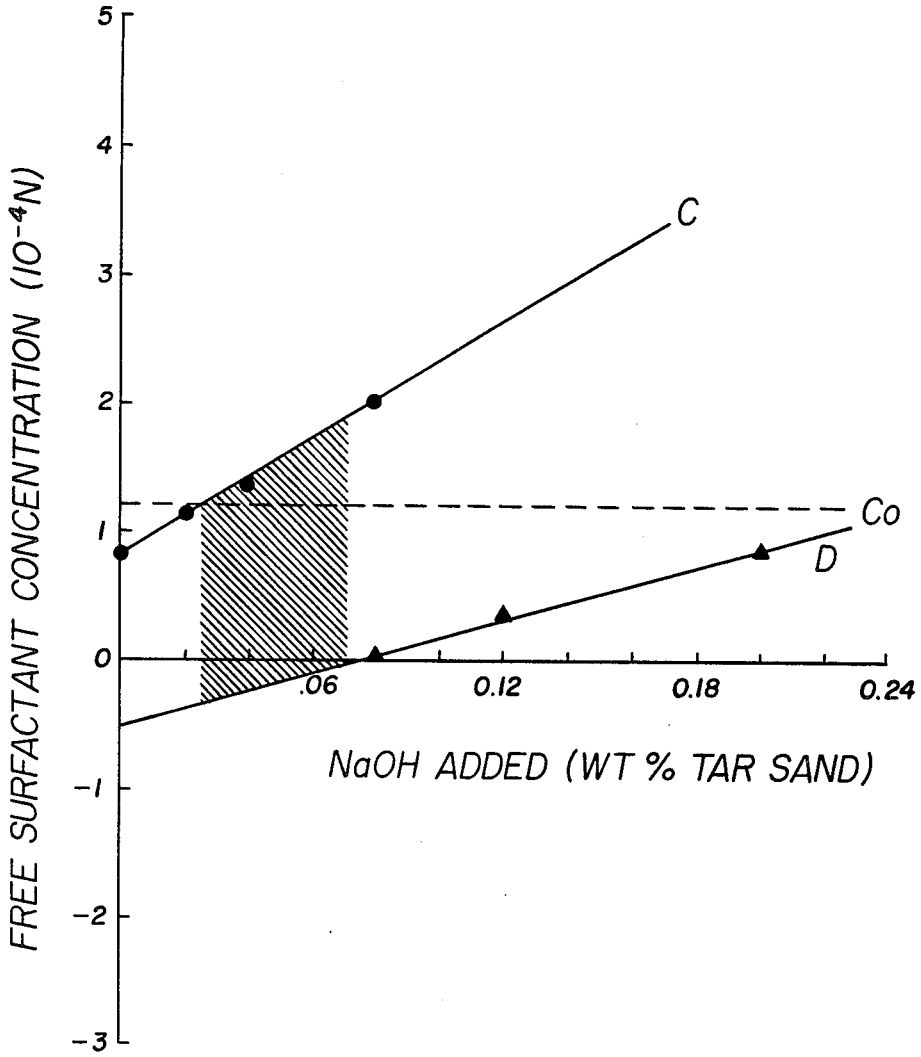
FIG. 4 is a plot, similar to that of FIG. 3, for two other tar sands C and D—tar sand C differs from tar sand A in that its intercept with the free surfactant concentration axis is less than $C_o$, whereas A's is greater—tar sand C is a free surfactant-producing tar sand, and tar and D is a free surfactant-consuming tar sand.

FIG. 4 is a plot showing the surfactant production lines for two tar sand feeds C and D to be blended, where the left hand end of the line for the producer feed is below the $C_o$ line when small NaOH additions are used in the extractions. Only when enough NaOH is used, so as to bring the producer line to at least $C_o$, can synergism result. So, for the blend of FIG. 4, the shaded area is shifted to the right in comparison to that of FIG. 3.

One may select compatible tar sand feeds to make up a blended feedstock which is amenable to processing at $C_o$ condition, by observing the following rules:

(1) select a first tar sand feed whose surfactant production line has a negative intercept value when plotted on a plot of the type of FIGS. 3 and 4 (that is, a feed which will consume free surfactants in the course of hot water extraction);

(2) select a second tar sand feed whose surfactant production line has a positive intercept value and which extends above the $C_o$ line (that is, a feed which will produce free surfactants in the course of hot water extraction in the absence of NaOH);

(3) the first feed surfactant production line having to cross the zero free surfactant concentration axis at a NaOH addition value which is less than 0.2 wt. % and greater than (a) the NaOH addition value corresponding with the second feed intercept (in which case the value is 0) or (b) the NaOH addition value corresponding with the point at which the second feed surfactant production line crosses the $C_o$ line, whichever is greater. Stated otherwise, the first vertical boundary line, passing through the point where the first feed surfactant production line crosses the zero free surfactant concentration axis, is to the right of or at a greater NaOH value than the second vertical boundary line, which passes through the point where the second feed surfactant production line crosses the $C_o$ line or, if it does not so cross, which coincides with the zero NaOH addition axis.

The amount of NaOH used in conjunction with the blended feedstock is selected so as to fall within the range of values between the two vertical boundary lines.

Having selected the feeds and NaOH addition to be used, one may determine the proportions of each feed to be used by solving the following equations:

$$C_o = X_1(C_{s,1} + R_1P) + X_2(C_{s,2} + R_2P) \quad (4)$$

$$1 = X_1 + X_2 \quad (5)$$

where:

$C_o$ is the optimum concentration of free surfactant in the aqueous phase of the process slurry for the extraction unit used $C_{s,1}$ and $C_{s,2}$ are the intercepts for the selected first and second feeds $R_1$ and $R_2$ are the slopes of the free surfactant production lines for the first and second feeds P is the process aid addition selected $X_1$ and $X_2$ are the proportions of first and second feeds used to make the blend.

There may, of course, be more than two components in the blend, in which case all values of X give a sum of 1.

The improvement in primary froth recovery which can be obtained by selecting free surfactant consuming and producing tar sand feeds as set forth, combining them with a NaOH addition selected from the range between the vertical boundary lines, and combining the tar sands in proportions established by solving equations (4) and (5), is demonstrated by the following example involving a blend of feeds A and B.

Figure 2:
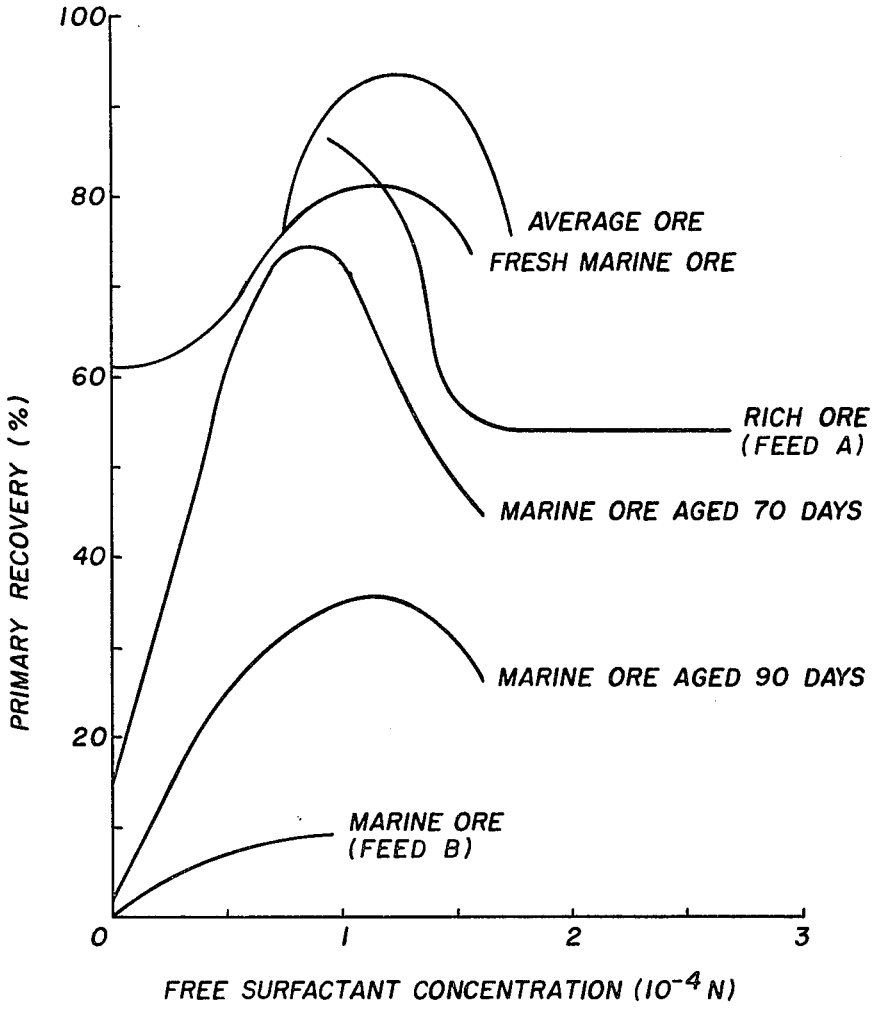
FIG. 2 is a peak curve plot for various tar sand type samples of primary froth recovery (%) against free surfactant concentration in secondary tailings—the data was obtained by conducting extractions on each feed at varying NaOH additions while holding other conditions constant.

Inspection of FIG. 2 shows that $C_o$ for the extraction unit of FIG. 1 was 1.2 and $10^4$N (i.e. equivalents per liter). Turning to FIG. 3, $C_{s,a}$ for feed A at zero NaOH addition was $1.45\times10^{-4}$N. The slope $R_a$ of the free surfactant line for feed A was $44.8\times10^{-4}$. For feed B, $C_{s,b}$ was $-0.45\times10^{-4}$N and $R_b$ was $11.9\times10^{-4}$.

With this blend, the left hand vertical boundary line coincided with the zero NaOH addition axis, and the right hand vertical boundary line occurred at 0.04 weight % NaOH. That is, the amount of NaOH to be added fell between 0.0 and 0.04 wt. %. With the aid of equations (4) and (5), one can calculate the amount of NaOH to be added for any blend of these feeds, to give maximum recovery.

For example, one can select a blend having a NaOH addition of 0.01%. Solving equations (4) and (5), one obtains recommended proportions of feed A and feed B as follows:

$$X_1 = 0.69$$

$$X_2 = 0.31$$

Hence one should blend

69% feed A with

31% feed B, when one uses a process aid level of 0.01 wt. % NaOH.

In fact, we blended 70% feed A and 30% feed B and performed extraction experiments at various NaOH levels from 0.0 to 0.04 wt. %. We then interpolated the results to find the bitumen in primary froth at the 0.01 wt. % NaOH level. We found the result to be 45 g bitumen. This is very close to the value of 46 g for a 70/30 blend (FIG. 5).

It remains to show that an improvement is obtained by processing the blend, compared with processing each feed separately, at the respective $C_o$ conditions.

Feed A, processed at 0.0 wt. % NaOH, gave 53.5 g bitumen. (0.0 NaOH is the nearest approach to $C_o$ for this feed [FIG. 3]. The recovery was 85.4% of the maximum attainable [FIG. 2]. Feed B was processed at 0.16% NaOH [this being as close as we came to the ideal value of 0.14, in our experimental program].) It gave 2.0 g bitumen, which, according to FIG. 2, was equivalent to 7.1% of the maximum attainable. Hence:

| Feed | Recovery |
|---|---|
| 250 g Feed A + 250 g Feed B processed separately | 0.7 × 53.5 + 0.3 × 2.0 = 38 g |
| 250 g Feed A blended with 250 g Feed B | 45.0 g |

These points can also be read off FIG. 5. As can be seen, there was an 18% improvement in recovery as a result of blending. It was known that the value of $C_o$ was reached in this case from equations (4) and (5) set forth above.

The embodiments of the invention in which an exclusive property or privilege is claimed are defined as follows:

1. A process for extracting bitumen from tar sand of varying nature using the hot water process in an extraction circuit, wherein the tar sand is conditioned, by slurring it with hot water and alkaline process aid with agitation, is diluted with water, and is then retained in a quiescent condition to produce primary bitumen froth, the improvement comprising:

selecting a first tar sand feed which, when slurried, is a consumer of free surfactants and a second tar sand feed which, when slurried, is a producer of free surfactants;

and blending said first and second tar sand feeds and process aid in the conditioning step in amounts selected to yield substantially the optimum free surfactant concentration, in the aqueous phase of the process slurry for the circuit, required to yield maximum primary froth recovery.

2. A process for extracting bitumen from tar sand of varying nature using the hot water process in an extraction circuit, wherein the tar sand is conditioned, by slurrying it with hot water and alkaline process aid with agitation, is diluted with water, and is then retained in a quiescent condition to produce primary bitumen froth, the improvement comprising:

determining, for the circuit involved, a measure of the optimum concentration of free surfactant in the aqueous phase of the process slurry, which substantially corresponds with maximum primary bitumen froth recovery from that circuit;

selecting a first tar sand feed which, when slurried, is a consumer of free surfactants and a second tar sand feed which, when slurried, is a producer of free surfactants;

and blending said first and second tar sand feeds and process aid in the conditioning step in amounts selected to yield substantially the optimum free surfactant concentration, in the aqueous phase of the process slurry for the circuit, required to yield maximum primary froth recovery.

3. In the process of extracting bitumen from tar sand of varying nature using the hot water process in an extraction circuit, wherein the tar sand is slurried in a conditioning drum with hot water and alkaline process aid, agitated, and then retained in a quiescent condition to produce primary bitumen froth, the improvement comprising:

(a) determining, for the circuit involved, a measure of the optimum concentration of free surfactant in the aqueous phase of the process slurry, which substantially corresponds with maximum primary bitumen froth recovery from that circuit;

(b) determining, for each of a plurality of tar sand feeds which are proposed for use to make a blended feedstock, the substantially linear relationship which exists between a measure of the concentrations of free surfactant, present in the aqueous phase of its process slurries, and the amounts of process aid added, when a plurality of hot water process extractions are practised on each tar sand feed at different levels of process aid addition, all other conditions being maintained substantially constant;

(c) selecting first and second tar sand feeds, from the group tested, such that, if the test data from steps (a) and (b) were plotted on a graph and cross-hatched in accordance with the appropriate figure selected from FIGS. 3 and 4, the first feed would have a surfactant production line whose intercept is above the zero surfactant concentration line and would have values above the optimum surfactant concentration line at a process aid addition value of less than 0.2 wt. %, the second feed would have a surfactant production line whose intercept is below the zero surfactant concentration line and would cross the zero surfactant concentration line at a process aid addition value less than 0.2 wt. % and greater than the process aid value corresponding with either the first feed intercept or the point where the first feed surfactant production line crosses the optimum surfactant concentration line, whichever is greater;

(d) selecting the process aid addition from the range of values between the vertical boundaries of the cross-hatched area;

(e) determining the proportions of first and second tar sand feeds to make a blended feedstock so that they satisfy the following equations:

$$C_o = X_1(C_{s,1} + R_1P) + X_2(C_{s,2} + R_2P)$$

$$1 = X_1 + X_2$$

where:

$C_o$ is the value determined in Step (a)

$C_{s,1}$ and $C_{2,s}$ are the intercepts for the selected first and second feeds $R_1$ and $R_2$ are the slopes of the surfactant production lines for said first and second feeds P is the process aid addition selected $X_1$ and $X_2$ are the proportions of first and second feeds used to make the blend;

(f) and supplying to the extraction process said first and second tar sand feeds and process aid in accordance with the values for $X_1$, $X_2$ and P.

* * * * *